US005320292A

United States Patent [19]

Smith

[11] Patent Number: 5,320,292

[45] Date of Patent: Jun. 14, 1994

[54] MOUNTING FOR REPLACEABLE HAMMERS IN IMPACT CRUSHER

[76] Inventor: Roger G. Smith, 17693 SW. Blue Heron Rd., Lake Oswego, Oreg. 97034

[21] Appl. No.: 973,047

[22] Filed: Nov. 6, 1992

[51] Int. Cl.[5] ..... B02C 13/28

[52] U.S. Cl. ..... 241/191; 241/195; 241/294; 144/229; 144/230

[58] Field of Search ..... 241/294, 195, 194, 191; 144/218, 230, 229

[56] References Cited

U.S. PATENT DOCUMENTS

| | | | |
|---|---|---|---|
| 1,996,485 | 4/1935 | Parker | 241/191 |
| 2,378,475 | 6/1945 | Gruender et al. | 241/191 |
| 2,747,803 | 5/1956 | Hanse | 241/191 |
| 3,355,113 | 11/1967 | Meger et al. | 241/294 X |
| 3,531,055 | 9/1970 | Alt | 241/191 X |
| 3,608,841 | 9/1971 | Wagender | 241/195 X |
| 3,784,117 | 1/1974 | Koenig et al. | 241/191 |
| 3,887,141 | 6/1975 | Francis | 241/195 X |
| 4,573,643 | 3/1986 | Orphall et al. | 241/195 X |
| 4,714,207 | 12/1987 | Schrödl | 241/195 X |
| 4,821,970 | 4/1989 | Puetz | 241/294 X |
| 4,925,114 | 5/1990 | Ostergaard | 241/191 |
| 4,967,969 | 11/1990 | Griffith, III | 241/294 X |
| 5,004,169 | 4/1991 | Ostergaard | 241/294 X |

FOREIGN PATENT DOCUMENTS

| | | | |
|---|---|---|---|
| 675015 | 11/1963 | Canada | 241/191 |
| 952862 | 11/1956 | Fed. Rep. of Germany | 241/191 |
| 2147920 | 3/1973 | Fed. Rep. of Germany | 241/191 |
| 2148752 | 4/1973 | Fed. Rep. of Germany | 241/191 |
| 2436336 | 2/1976 | Fed. Rep. of Germany | 241/191 |
| 2436338 | 2/1976 | Fed. Rep. of Germany | 241/191 |
| 3742395 | 6/1989 | Fed. Rep. of Germany | 241/191 |
| 874048 | 8/1962 | France | 241/191 |
| 1396194 | 6/1975 | United Kingdom | 241/191 |
| 1454633 | 11/1976 | United Kingdom | 241/191 |

*Primary Examiner*—Mark Rosenbaum
*Assistant Examiner*—Frances Chin
*Attorney, Agent, or Firm*—Kolisch, Hartwell, Dickinson, McCormack & Heuser

[57] ABSTRACT

A rotor for an impact crusher which has rotor plates distributed along the length of a rotor shaft and secured to the shaft. Aligned, open, recessed cavities in multiple rotor plates receive a backing bar spanning the plates and the bar is secured to the plates. A removable hammer bar seats in the cavities and rests against the backing bar. Wedges held in place by retainers hook the hammer bar in place.

1 Claim, 3 Drawing Sheets

MOUNTING FOR REPLACEABLE HAMMERS IN IMPACT CRUSHER

BACKGROUND AND SUMMARY OF THE INVENTION

This invention relates to what is sometimes referred to as an impact crusher, and more particularly to a construction for the rotor in the crusher which is rotated to produce a breaking up of the material handled.

A conventional impact crusher has a frame including a hood portion which encompasses a crushing chamber within the crusher. A power-driven rotor is rotatably supported within the crusher, with the rotor supporting one or more hammers distributed about the periphery of the rotor. Material fed into the crusher cascades downwardly to fall against the rotor and be impacted by the hammers described as the rotor is rotated at high speed. The impact of a hammer striking the material being processed produces fragmentation of the material. A crusher of this description is disclosed in my copending application entitled "Impact Crusher with Biased Tertiary Curtain Assembly", filed October, 1992.

In a rotor for an impact crusher, it is important that any hammers provided be capable of operating over an extended period of time without replacement required. By constructing the hammer and its mounting in such a manner that the hammer may be turned over to provide a new striking edge, the service life of the hammer is appreciable extended. Any mounting for the hammer should hold it securely in place, since it should be obvious that were a hammer to work lose during operating of the crusher, because of the operating speed of the rotor and the weight of the hammer, considerable damage could result. While a hammer should be held securely, nevertheless, the mounting for the hammer should be such as to enable the hammer easily to be removed and turned over or replaced.

A general object of the present invention is to provide a new and improved construction for the rotor in an impact crusher which takes care of the above-described requirements in a highly practical and satisfactory manner.

More specifically, an object is to provide an improved rotor for an impact crusher, which features plural hammers or hammer bars distributed about the rotor, and a mounting whereby a hammer bar is securely held in its intended operating position, the mounting nevertheless being readily disassembled when rotor repair is required.

Yet another object is to provide such a rotor with hammer bars for producing the impacting action where a bar has two working shoulders, and is capable of being turned over in its mounting when one shoulder of the bar becomes worn to place an opposite unworn shoulder in operating position.

As contemplated herein, a hammer bar may be removed from its mounting on a rotor with lifting of the bar in a direction extending generally radially of the axis of the rotor, which in a typical crusher might be in an upward direction where there is easy access to the interior of the crushing chamber. Bar removal may further be done without the need of extensive equipment. Bar removal is considerably easier than in organizations where the bar must be shifted in a longitudinal direction, or in a direction extending axially of the rotor.

A further object is to provide a rotor construction which provides replaceable wear surfaces in regions of the rotor where appreciable wear occurs.

Yet a further object is to provide a rotor which employs wedge members and wedge retainers for holding a hammer bar in place, and such a construction where the wedge members and retainers are reversible.

BRIEF DESCRIPTION OF THE DRAWINGS

These and other objects and advantages are attained by the invention, which is described hereinbelow in conjunction with the accompanying drawings, wherein.

DETAILED DESCRIPTION OF THE PREFERRED EMBODIMENT

Figure 1:
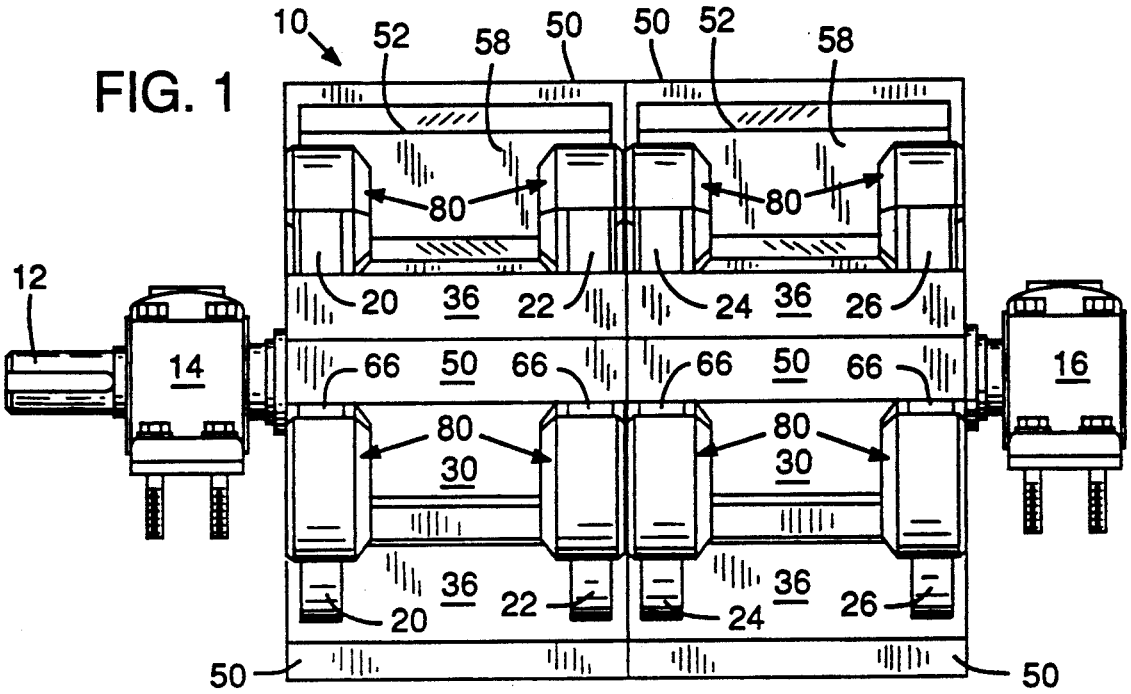
FIG. 1 is a side view of a rotor constructed according to the invention.
Figure 2:
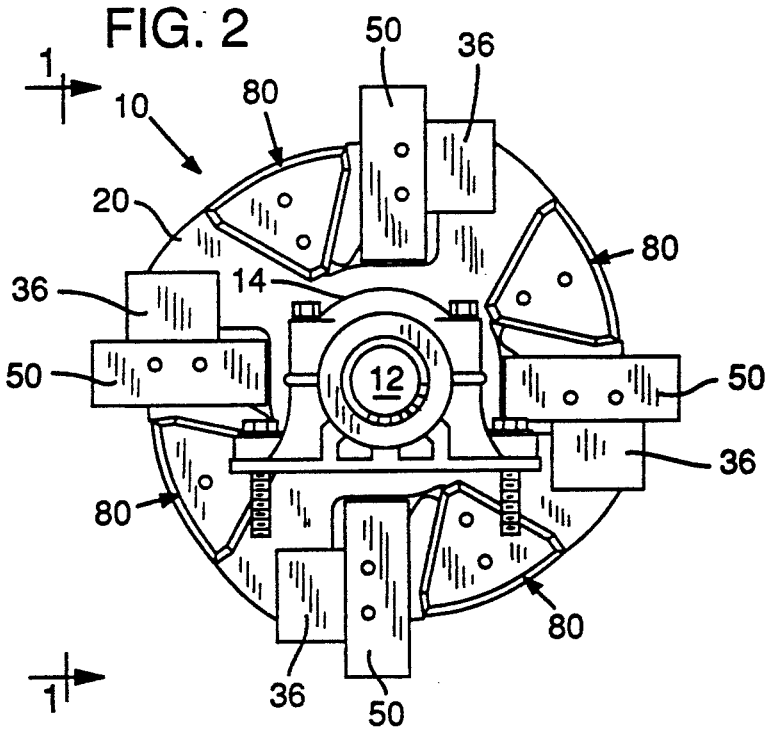
FIG. 2 is an end view of the rotor shown in FIG. 1.

Referring now to the drawings, and initially to FIGS. 1 and 2, a rotor for an impact crusher is indicated generally at 10. The rotor includes a rotor shaft 12 extending axially through the rotor. Ends of the shaft, referred to herein as shaft extensions, are journaled within bearings 14, 16 forming part of the impact crusher. The rotor is power-driven by a motor suitably drivingly connected to a protruding end of the shaft. During operating periods of the crusher the rotor normally is rotated at a relatively high speed, whereby hammers or hammer bars in the rotor properly impact the material handled thus to break it down.

For further details of a crusher such as might employ the rotor herein described, reference is had to my earlier filed application.

Also part of the rotor are rotor plates 20, 22, 24 and 26 suitably secured to the shaft at locations distributed along the length of the shaft. The rotor plates may all have the same size and shape. With smaller units only two plates may be needed, with these adjacent opposite extremities of the rotor. With larger units, as illustrated in the drawings, it may be desirable to include additional plates between the end extremities of the rotor, as shown.

Figure 3:
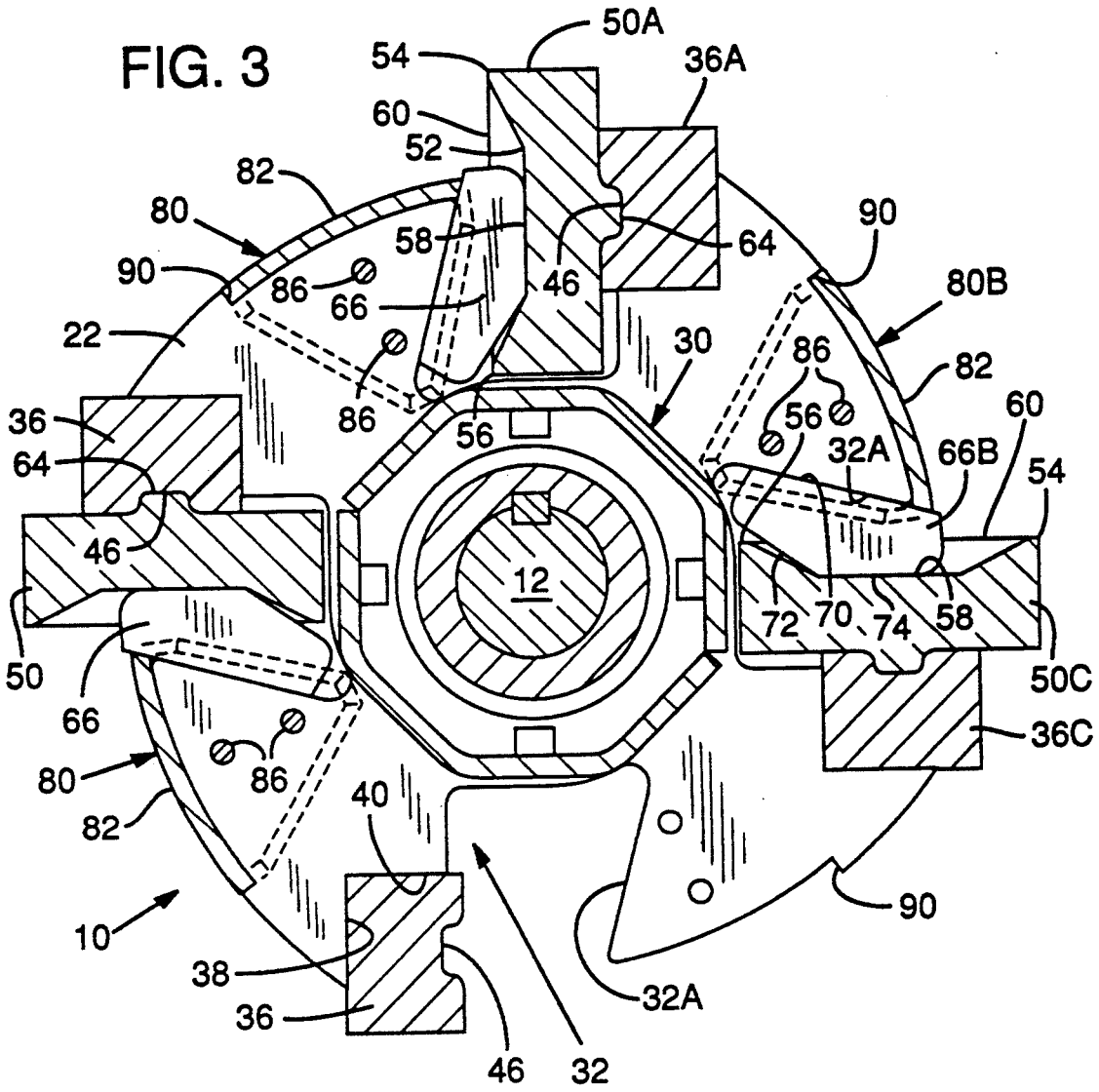
FIG. 3 is a cross-sectional view through the rotor, on a slightly enlarged scale and with parts removed.

Encompassing shaft 12 and fending material away from central regions of the rotor is shield structure 30 (see FIG. 3).

The rotor plates, as earlier described, may all have the same construction. Each is provided with a series of cutouts distributed circumferentially about the plate, as illustrated by cutouts 32. The cutouts have open mouths facing outwardly. The cutouts are also referred to herein as open recessed cavities.

Figure 5:
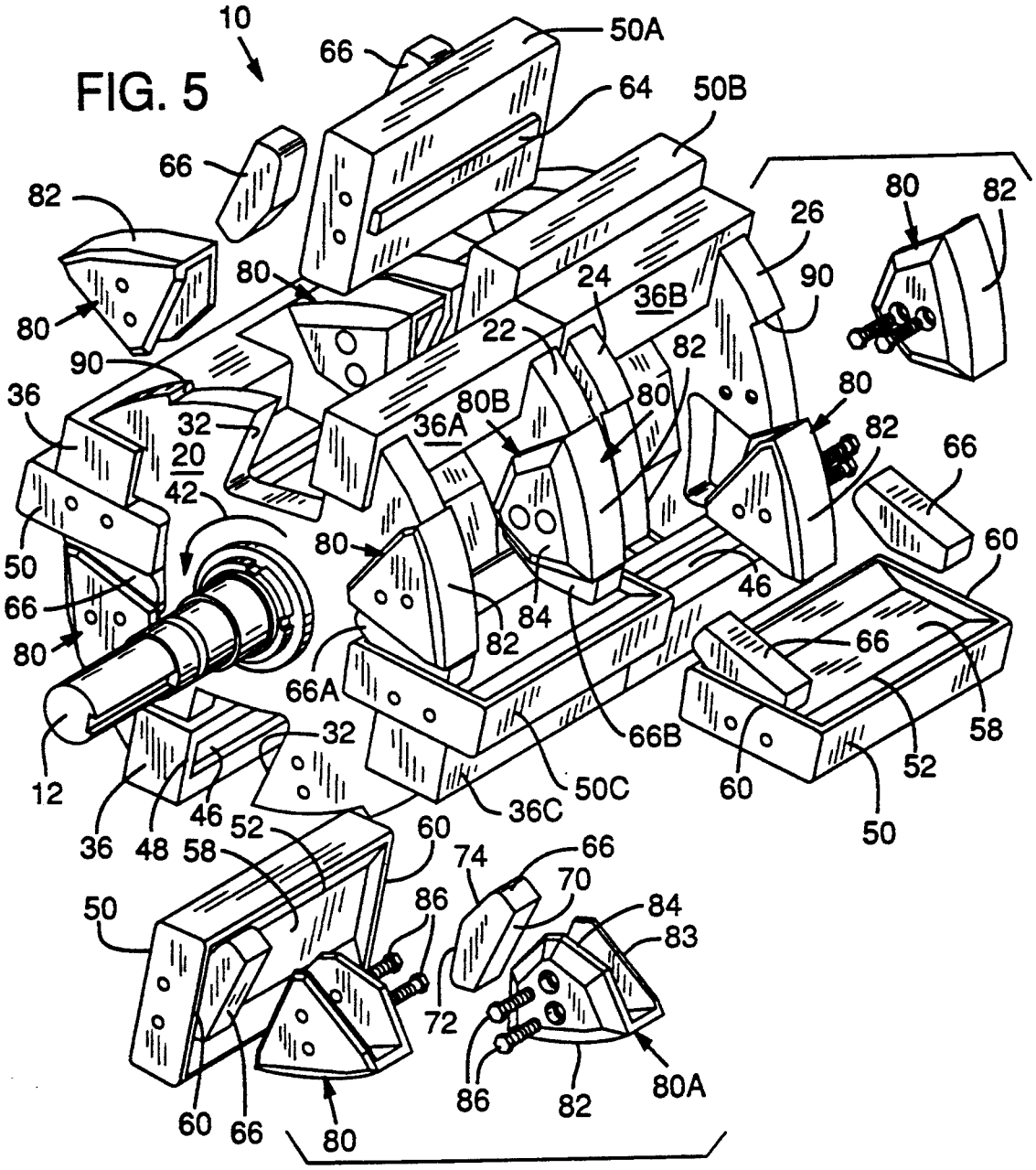
FIG. 5 is a perspective view, partially exploded, further illustrating the rotor of the invention.

Spanning multiple cutouts in the rotor, and extending axially of the rotor axis, are backing bars 36. In FIG. 5, two backing bars 36A, 36B disposed end-to-end span aligned cutouts in rotor plates 20, 22 and rotor plates 24, 26. In an alternative construction, one continuous backing bar may extend through all four of the aligned cutouts. A similar configuration is provided in the aligned cutouts in regions distributed circumferentially about the rotor.

The cutouts are configured to have edges, such as edges 38, 40 shown in FIG. 3, to have a shape complementing the shape of the back of a backing bar. The backing bars may be secured in place, as by welding.

The rotor plates and backing bars, which are all joined to each other and to the rotor shaft, make up what is referred herein as a rotor body in the construction. In the rotor body, pocket structures are defined in circumferentially distributed regions of the rotor body. Illustrative of a pocket structure is the open space in FIG. 5 provided by the aligned cutouts 32 adjacent the top of the rotor body in FIG. 5 and delineated on one side by the front side of back up bars 36. During operation of the rotor, the rotor is rotated in a counterclockwise, as illustrated in FIG. 5, or in the direction of arrow 42. The sides of backup bars 36 which face toward the left in the figure are referred to as the front sides, as these sides face the direction of travel of the rotor.

Figure 4:
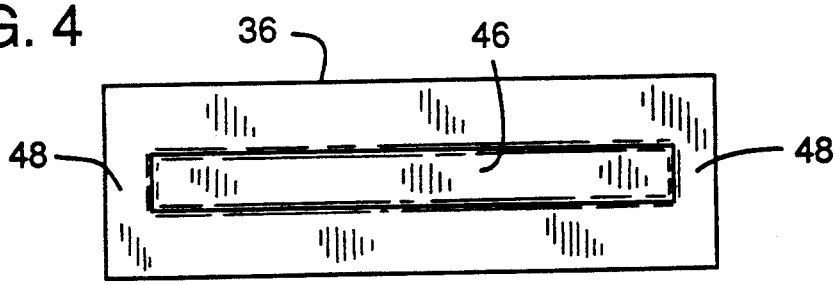
FIG. 4 is a view looking at the front side of a backing bar in the construction.

Each backing bar, as can be seen in FIG. 4, has an elongate recessed channel extending in the direction of its length and provided along the front side of the bar. In FIG. 4 this channel is shown at 46. The channel does not extend the full length of the bar, but is closed off at its end by what are referred to as end closures 48.

A pair of hammer bars 50 are mounted in each pocket structure of the rotor. Each hammer bar is an elongate element having (and refer to FIG. 3) a concave front side 52 which is the side of the bar facing in the direction of travel of the rotor. This concavity is provided by shoulders 54, 56 in the hammer bar adjacent inner and outer margins of the bar, and a depressed face 58 between these shoulders. Extending transversely of the hammer bar adjacent each of its ends is a flange 60. The rear or back side of the hammer bar has an elongate rib 64 extending therealong. The rib does not extend the full length of the hammer bar, but terminates at its ends slightly short of the ends of the hammer bar.

In the construction of the rotor shown, two hammer bars are detachably seated in each pocket structure of the rotor. Thus, in FIG. 5, hammer bar 50A mounts in the rotor with its back side supported by the front side of backing bar 36A. Hammer bar 50B fits in the pocket structure with its back side supported by the front side of backing bar 36B. The elongate rib of each hammer bar seats within the channel 46 provided in the backing bar behind it. Ends of the rib are captured between the end closures which close off the ends of this recessed channel. With the hammer bar snugly held against the backing bar, the construction described prevents movement of the hammer bar both in a radially direction and in an axial direction.

Locking each hammer bar in place with such firmly against the backing bar behind it are a pair of wedge members, as exemplified by wedge members 66. In FIG. 5, hammer bar 50C is shown seated snugly against backing bar 36C. Wedge members 66A and 66B hold the hammer bar in place.

A wedge member is moved into position on a rotor plate by shifting such in an axially direction into that portion of a cutout which extends between the leading edge of the cutout and the front side of the hammer bar lodged within the cutout. This places a wedge member, as shown in connection with wedge member 66B in FIG. 3, with the wedge member between the leading edge 32A of the cutout depicted and the front side of hammer bar 50C. A wedge member has three principal surfaces, namely surface 70, 72 and 74. As so positioned, surface 70 of the wedge member is against edge 32A of the cutout, and surface 74 of the wedge member is against depressed face 58 of the hammer bar.

As so positioned, face 58 of the hammer bar and edge 32A of the cutout, which are wedge-engaging surfaces, converge on each other progressing radially outwardly on the rotor. The wedge surfaces of the wedge member which engage these wedge-engaging surfaces are surface 70 and 74. These surfaces converge on each other progressing in a radial outward direction, and complement the converging wedge-engaging surfaces of the pocket structure and hammer bar.

As a result of the above construction, with rotation of the rotor, centrifugal force tends to urge the wedge members outwardly to create a tight fit of the wedge members against any hammer bar which they engage.

Holding the wedge members in place, and preventing relative axial displacement out of the pocket, are retainers 80. The retainers, as shown by retainer 80A in FIG. 5, have U-shaped bodies, with an outer wear surface 82 and legs 83, 84. When mounted in place, as shown by retainer 80B in FIG. 5, the legs straddle the rotor plate and the wear surface becomes positioned adjacent the periphery of a rotor plate immediately in advance of the hammer bar. Fasteners 86 secure a retainer in place.

With the retainer mounted and held in place by the fasteners, the fasteners hold the retainer from radial displacement on the rotor plate. Since the retainer has legs which straddle the rotor plate, the retainer can not move with respect to the rotor plate in an axial direction. Edge margins of legs 83, 84 protrude out into the cutout region and overlap margins of a wedge member located therebetween. This overlapping relationship prevents a wedge member captured by the retainer from shifting axially with respect to the rotor.

A rotor plate has a slight notch in its periphery in the region where it is to receive a retainer. This notch is illustrated in FIGS. 3 and 5 at 90.

Many of the parts in the construction described are reversible, in the sense that they may be mounted in different positions in an operable fashion. For instance, a hammer bar 50 has earlier been described as having two shoulders. In FIG. 3, hammer bar 50C is shown mounted with its shoulder 54 held outwardly on the rotor and its shoulder 56 held inwardly. The hammer bar may be removed from the rotor and turned end-for-end, and then remounted, to place shoulder 56 in a radially outer position and its worn shoulder 54 in a radially inner position. This feature contributes substantially to the life to be expected from a hammer bar.

The wedge members themselves also may be turned over and placed in operative position after wear has occurred. Considering wedge member 66B shown in FIG. 3, the wedge member is symmetrical, so that it may be removed and turned end-for-end, to place wedge surface 72 in an outer position and wedge surface 74 in a radially inner position.

The retainers also may be turned about and returned to an operative position on the rotor. When this is done, it is possible to change that portion of a wear surface 82 which is closer to the hammer bar with rotation of the rotor.

Flanges 60 have been described which extend transversely of a hammer bar at the end of each hammer bar. These flanges come up against lateral surfaces of the wedge members to produce a further confining action, which inhibits relative axially movement of the hammer bar in the rotor. Further, the flanges function to keep fragmented material being handled from moving laterally of the rotor plates to build up in regions adjacent the ends of the rotor.

With the construction described, it is a relatively easy matter to remove a hammer bar, and then to replace it, either with a new hammer bar or with the same hammer bar turned over, to place a different shoulder in operative position. This is done by removing the two retainers which hold the wedges locking a hammer bar in place. With the retainers removed, the wedges themselves can be displaced and removed, which frees the hammer bar for disassembly from the rotor. The hammer bar is moved out of the rotor with movement in a radial direction, because the pocket structure which receives a hammer bar has sufficient size to permit this type of disassembly.

While an embodiment of the invention has been described, it should be apparent that variations and modifications of the invention are possible without departing therefrom.

I claim:

1. A crusher rotor for an impact crusher comprising:

an elongate rotor shaft and at least a pair of rotor plates spaced from each other on the shaft and secured to the shaft, a pair of cavities, one recessed inwardly from the perimeter of each plate and the cavities being axially aligned, a backing bar extending between and mounted within the cavities secured to the rotor plates, the backing bar having a front side facing the direction of travel of the rotor and including an axially extending channel indented into said side, an elongate hammer bar extending between and mounted within the cavities with the hammer bar located forwardly of the backing bar and the hammer bar having a rib seated within said channel, said hammer bar having a front side that faces the direction of travel of the rotor and inner and outer shoulders on said front side extending longitudinally of the bar from adjacent one end to adjacent the other end of the bar and a recess on said front side extending longitudinally of the bar intermediate said shoulders, the cavity of each rotor plate having a wedge-engaging surface extending within it and the hammer bar having a wedge-engaging surface in its said recessed region disposed opposite and facing the wedge-engaging surface of the rotor plate and the wedge-engaging surface of a cavity and the wedge-engaging surface of a rotor plate converging on each other progressing radially outwardly on the rotor plate, and a separate detachable wedge member for each of said rotor plates, each wedge member being wedged between the wedge-engaging surface of the rotor plate and the opposed wedge-engaging surface of the hammer bar, the hammer bar further having a transverse raised flange disposed immediately axially outwardly of each wedge member at each end of the hammer bar extending transversely of the shoulders and forming an end of the recessed region.

* * * * *